US011617437B2

(12) United States Patent
Sandana

(10) Patent No.: US 11,617,437 B2
(45) Date of Patent: Apr. 4, 2023

(54) TILE SUPPORT DEVICE

(71) Applicant: VERSATILE PRODUCTS LLC, Puyallup, WA (US)

(72) Inventor: David Julio Sandana, Puyallup, WA (US)

( * ) Notice: Subject to any disclaimer, the term of this patent is extended or adjusted under 35 U.S.C. 154(b) by 0 days.

(21) Appl. No.: 17/696,686

(22) Filed: Mar. 16, 2022

(65) Prior Publication Data

US 2022/0295986 A1 Sep. 22, 2022

Related U.S. Application Data

(60) Provisional application No. 63/161,637, filed on Mar. 16, 2021.

(51) Int. Cl.
*A47B 77/02* (2006.01)
*A47B 96/18* (2006.01)

(52) U.S. Cl.
CPC ..... *A47B 77/022* (2013.01); *A47B 96/18* (2013.01)

(58) Field of Classification Search
CPC ..... A47B 96/18; A47B 77/022
See application file for complete search history.

(56) References Cited

U.S. PATENT DOCUMENTS 3,871,147 A 3/1975 Stegmeier
5,330,262 A 7/1994 Peters
5,733,022 A * 3/1998 Whetstone ..... A47B 77/022 4/631
6,220,677 B1 * 4/2001 Ancel ..... A47B 77/022 312/140.4
6,343,454 B1 * 2/2002 Fisher ..... A47B 96/18 52/782.2
6,843,183 B2 * 1/2005 Strong ..... A47B 9/14 248/188.5
2013/0082160 A1 * 4/2013 Hsiao ..... E04G 13/068 249/189
2016/0095438 A1 * 4/2016 Costello ..... A47B 95/043 428/189
2020/0229589 A1 * 7/2020 Hill ..... A47B 77/022
2021/0204691 A1 * 7/2021 Duesler ..... A47F 9/00

FOREIGN PATENT DOCUMENTS

AT 521640 A1 3/2020
WO 2004006718 A1 1/2004

OTHER PUBLICATIONS

"ProLeveling System PRST Blue Tensioning Cap (50/Bag)," Tools4flooring.com. https://www.tools4flooring.com/proleveling-system-prst-blue-tensioning-cap-50-bag.html [Date accessed: Dec. 12, 2020].

* cited by examiner

*Primary Examiner* — Matthew W Ing
(74) *Attorney, Agent, or Firm* — Bold IP, PLLC; Houda El-Jarrah

(57) ABSTRACT

A tool for supporting tiles on a wall being applied to the wall while drying between two countertops. The tile support device includes an elongated body and two longer side pieces that can balance on each countertop. The tile support device includes a ledge or ridge that couples to an angled surface or sloped surface. The tile support device can be positioned beneath a last level or row of drying tiles without having to fasten the tool to a wall surface or other surface therefore preventing damage to the wall surface or other surface from fasteners. The tile support device can be easily positioned and removed from beneath the last level or row of drying tiles that are drying on the wall.

20 Claims, 6 Drawing Sheets

TILE SUPPORT DEVICE

CROSS-REFERENCE TO RELATED APPLICATIONS

This application is a non-provisional application which claims priority to U.S. Provisional Patent Application No. 63/161,637 filed on Mar. 16, 2021, which is incorporated by reference in its entirety.

FIELD OF THE DISCLOSURE

The present invention relates to a tool for supporting tile over a gap between countertops or other level, plane surfaces.

BACKGROUND

Contractors and other tile installers often must apply tile to a wall surface where there may not be any support from a countertop or other level surface beneath the tile. For example, the location in most kitchens where a stove unit is supposed to be inserted includes an empty space and a gap between each countertop to fit a stove unit. In most residential homes and apartments, this gap between each countertop where a stove is intended to be is usually at least 30 inches long. A backsplash is often the term of art used to describe tile located in between cabinets and countertops and/or positioned over a stove. A backsplash may be a vertical wall of tile applied in rows and levels that may be decorative as well as functional because the tile protects the wall surface. It is noted that there may be other areas of the kitchen, bathroom, or home where a tile installer is asked to install tile against a wall surface and there may be a wide gap and open area between two countertops or other level surfaces.

A problem for tile installers when applying tile to a wall surface is that while the tile is drying, the tile installer must use something to support the tile or else the tile may fall off until the tile is fully bonded and dried against the wall. Currently, tile installers and other contractors often use one or more pieces of wood or metal or plastic or another type of element and then fasten that crude support piece to the wall beneath a row of tile that is spanning a gap area and has no underlying countertop to support the tile. The contractors may use fasteners such as screws or nails in some cases to fasten the crude support pieces. The contractors may also or alternatively use glue or other adhesives to attach these conventional and crude support pieces to the wall area in the open area between countertops. Once the tile has fully bonded to the wall surface and the bonding material applied to the back of the tiles (e.g., mortar, grout, or mastic) has fully dried, the tile installer or other contractor can remove the piece of wood or metal or other support element. But, because this piece has been either glued or fastened to the wall using nails or screws, the wall surface where the support piece has been applied is inherently damaged when the tile installer or other contractor removes this support piece. The wall surface must then be repaired where the support piece was attached to the wall surface, which may include added time and expense to repair the wall surface, including repairing any holes or tears to the wall surface, including the dry wall, and repainting the part of the wall surface that is not covered in any tile and that was affected by the removal of the attached support piece.

Accordingly, there is a need for an improved system and method to support tile between two countertops over an existing gap without damaging the wall surface.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

SUMMARY

Figure 1:
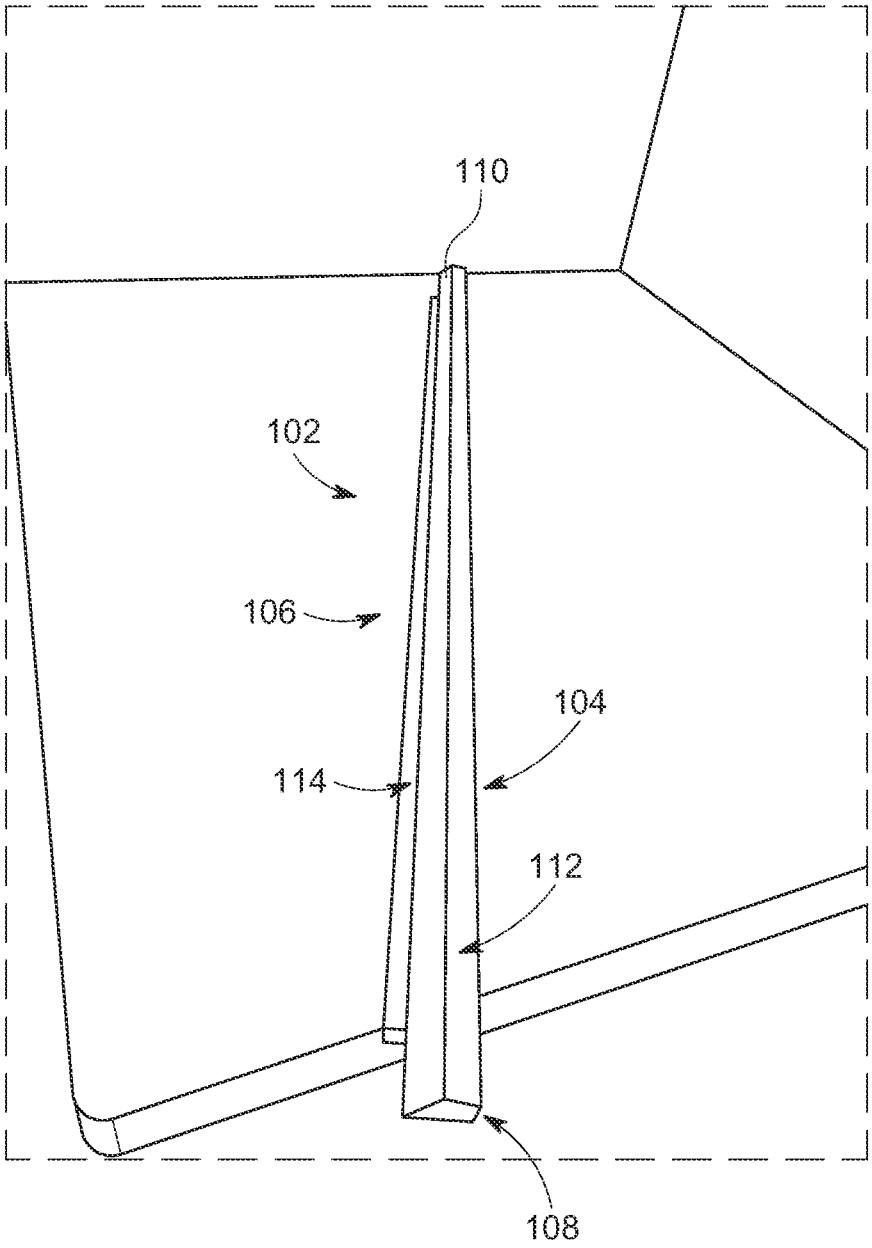
FIG. 1 is a pictorial illustration of a left side perspective view of a tile support device in accordance with an illustrative embodiment.

The present description includes embodiments for a tile support device comprising an elongated body that is a single unit and horizontally oriented. The tile support device comprises an upper section having a top surface and a sloping back surface, wherein the upper section further comprises two side ends. The lower section comprises a support ledge and two side ends, wherein the support ledge is a flat, top surface of the lower section and is offset from the sloping back surface of the upper section, whereby the sloping back surface of the upper section terminates just before the support ledge. The two side ends of the upper section included extended portions that each extend a measurable distance past each side end of the lower section. Each side end of the upper section is an irregular trapezoidal shape having a straight front surface and the sloping back surface on an opposed side of the straight front surface in a non-limiting embodiment. In a non-limiting embodiment, the lower section is rectangular shaped and the top surface of the upper section is an elongated flat surface. A back surface of the lower section is flat. Further, each extended portion extends a same amount past each side end of the lower section and are the same length. In a non-limiting embodiment, the tile support device is machined as a single integral piece. Further, in a non-limiting embodiment, the tile support device is made partially or entirely of metal. In a non-limiting embodiment, the tile support device is configured to support drying tile that is bonded to a wall surface over a gap that exists between a first countertop and a second countertop without having to attach the tile support device to the wall surface.

In another aspect, the present description includes a method for using a tile support device. The method may include providing a tile support device in accordance with the above description. The method may further include measuring and verifying a width of the gap between the first countertop and the second countertop. Once the width of the gap is measured and verified, placing a first extended end of an upper section of a tile support device on a top surface of the first countertop. The method may further include placing a second extended end of the upper section of the tile support device on a top surface of the second countertop, wherein upon placement, the tile support device spans the gap existing between each countertop. The method may further include sliding the tile support device back towards the wall surface until a back side of the lower section of the tile support device contacts the wall surface and/or supports a first level of tile. The method may further include supporting the first level of tile that has been applied to the wall surface on the support ledge of the tile support device. Once the first level of tile is bonded to the wall surface, removing the tile support device by tilting the tile support device in a downward direction and pulling the tile support device away from the wall surface. Notably, the tile support device is not attached or otherwise coupled to the wall surface. Further, the first extended end of the upper section contacts the top surface of the first countertop and the second extended end of the upper section contacts the top surface of the second countertop. Further, any bottom surfaces of any tile arranged in the first level of tile are contacting a top surface of the support ledge of the tile support device when the tile support device is installed in place. Further, the lower section supports the upper section of the tile support device. The first side surface of the lower section contacts a side surface of the first countertop and a second side surface of the lower section contacts a side surface of the second countertop when the tile support device is installed. Advantageously, the tile support device can be installed and removed using one hand.

Other aspects and advantages of the invention will be apparent from the following description and the appended claims.

DETAILED DESCRIPTION

The present description includes embodiments for a horizontal tile support device that may be used to support tile applied and attached to a wall surface. Advantageously, the tile installer or other contractor does not have to fasten or otherwise attach a support element beneath tile that has been applied to a wall surface and is still drying over a gap between counter tops or other level surfaces. As noted above, many contractors damage the wall surface when they attach a support element beneath such tile and/or backsplash installations and must spend additional time and money to repair the damaged wall.

In one or more non-limiting embodiment, a tile support device is described herein that is formed as a single piece or single unit having an upper section and a lower section. The tile support device includes a slope and slant surface on one side of the upper section that terminates at or just above a support ledge of the lower section of the tile support device. The support ledge may be used to support a first level of tile positioned over a gap or empty space between two countertops. Each side of the upper section of the tile support device extends a distance past the lower section and is configured to securely rest on top of a top side of each countertop in order to hold the tile support device in place. Further details are provided with respect to the Figures.

Figure 5:
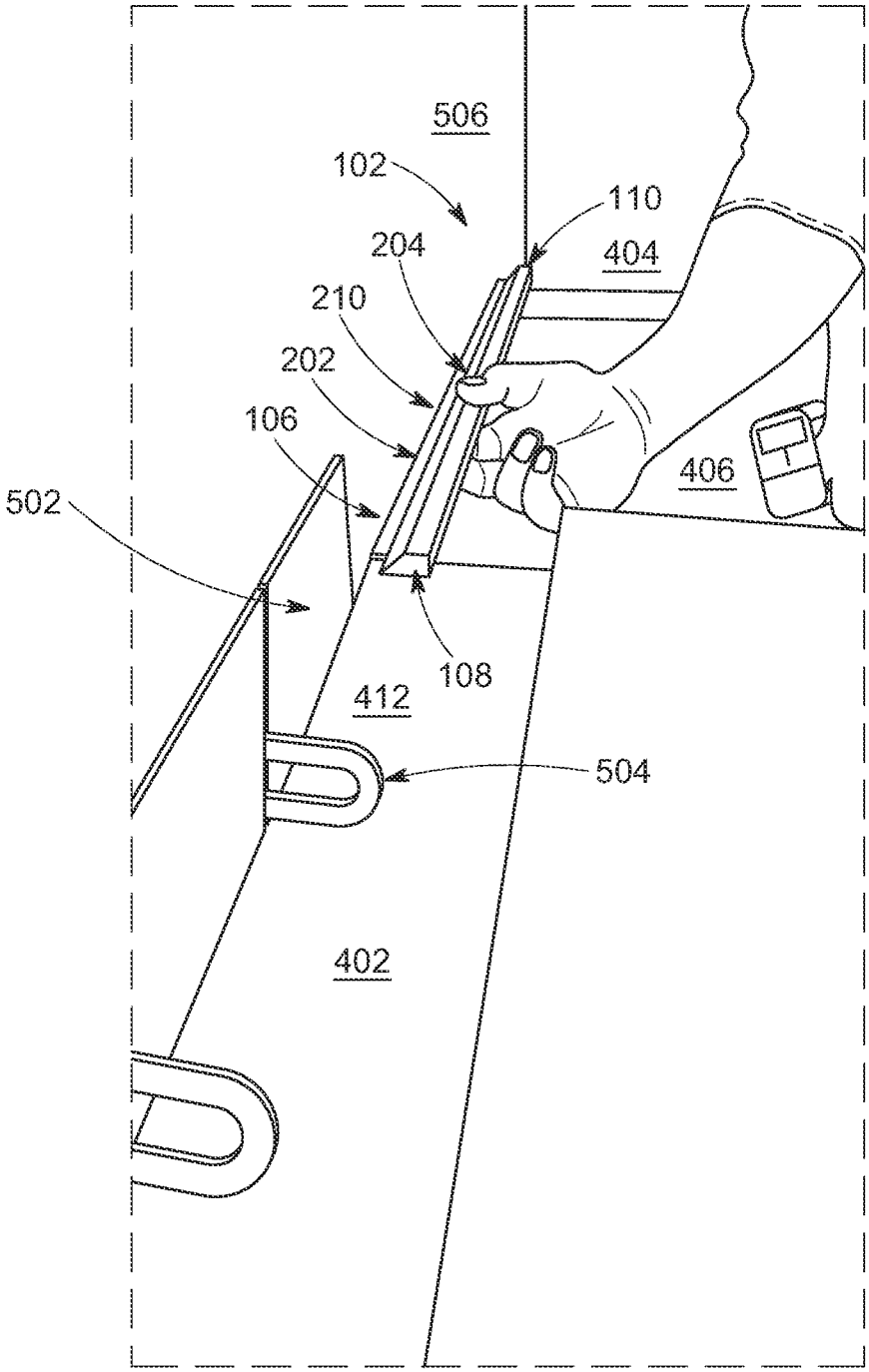
FIG. 5 is a pictorial illustration of the tile support device shown in FIG. 1 against a wall surface and spanning a gap between two countertops in accordance with an illustrative embodiment.
Figure 6:
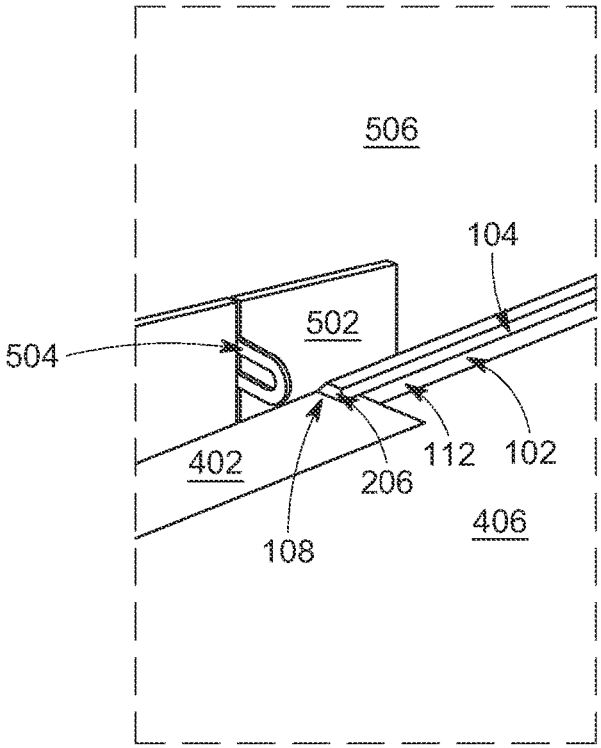
FIG. 6 is a pictorial illustration of a close-up view of one end of the tile support device shown in FIG. 1 supporting a tile on a countertop in accordance with an illustrative embodiment.
Figure 7:
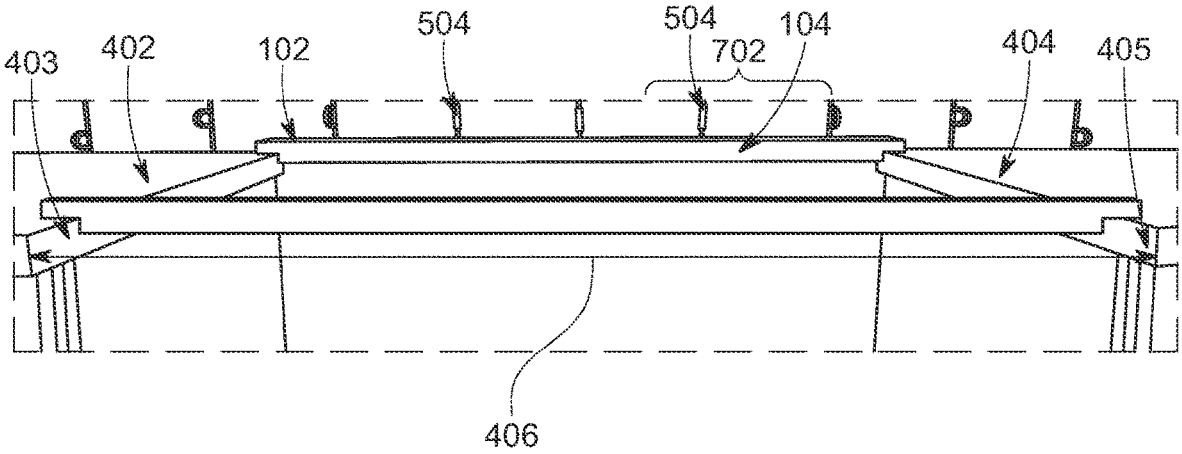
FIG. 7 is a pictorial illustration of the tile support device shown in FIG. 1 supporting one or more levels of tile over a gap and empty space between two countertops in accordance with an illustrative embodiment.

FIG. 1 shows a left side perspective view of tile support device 102. Tile support device 102 may be a tool useful to tile installers and other contractors to support tile after tile has been applied and is bonded to a wall surface (e.g., as shown in FIG. 5-FIG. 7). The tile support device 102 omits any need to have to fasten or otherwise temporarily attach a support piece to the wall surface to hold up the tile that is applied to the wall using damaging fasteners or adhesive, which is currently how such tile is applied to wall surfaces which results in extensive damage to a wall surface after the support piece is unfastened or detached from the wall.

Figure 2A:
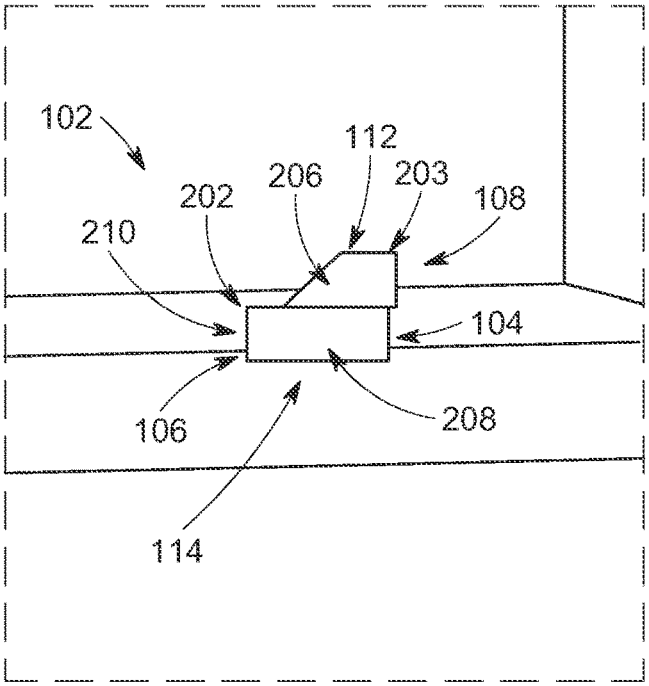
FIG. 2A is a pictorial illustration of a left side view of the tile support device shown in FIG. 1 in accordance with an illustrative embodiment.
Figure 2B:
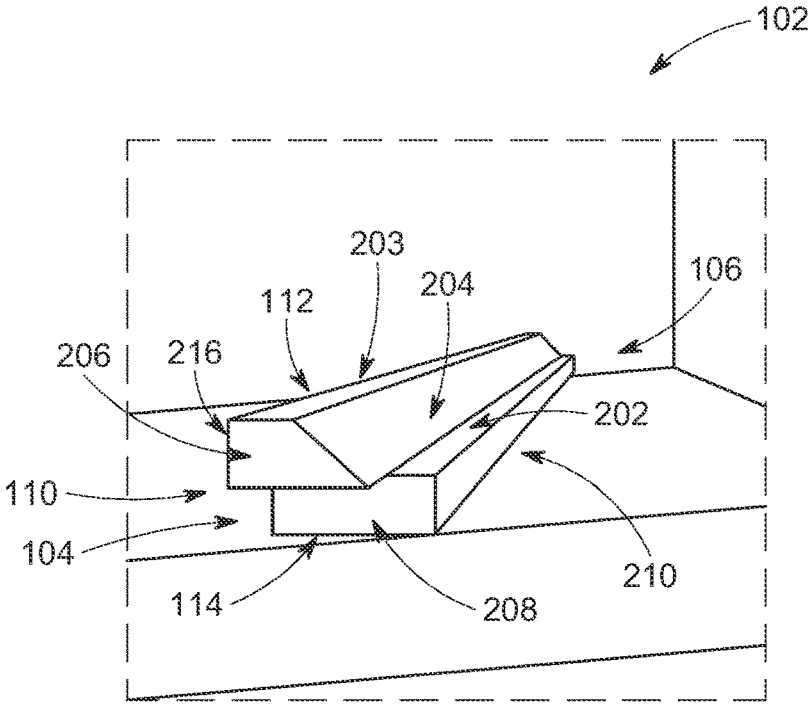
FIG. 2B is a pictorial illustration of a right side perspective view of the tile support device shown in FIG. 1 in accordance with an illustrative embodiment.
Figure 3:
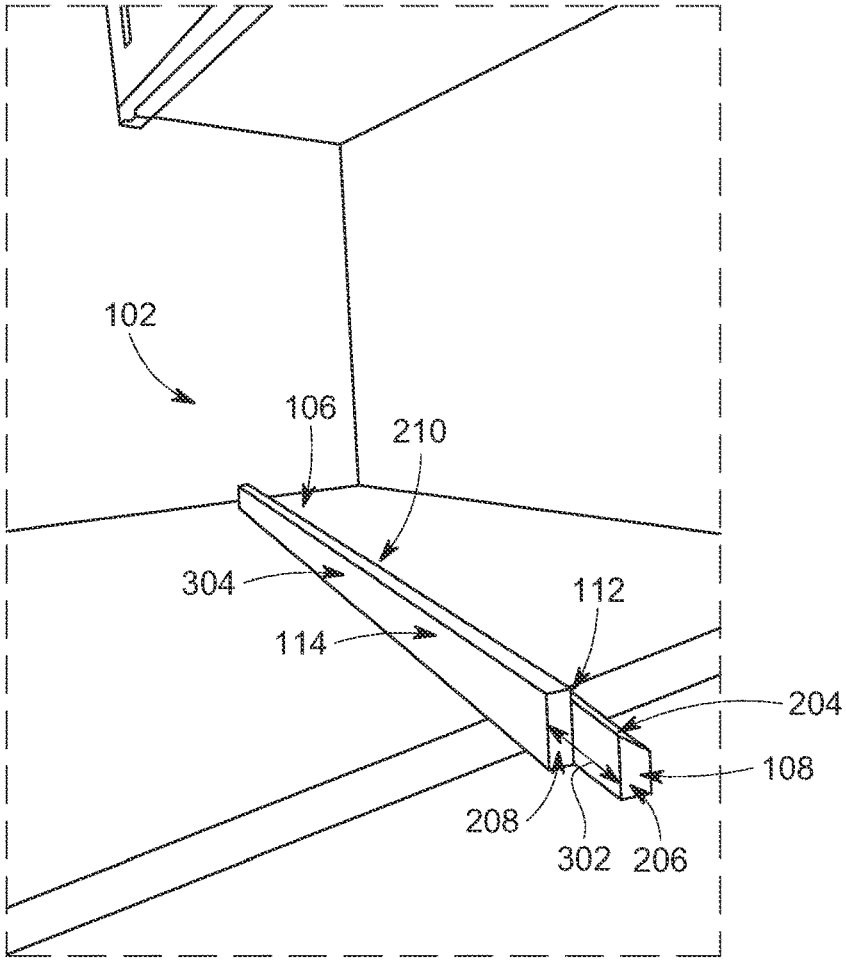
FIG. 3 is a pictorial illustration of a bottom perspective view of the tile support device shown in FIG. 1 in accordance with an illustrative embodiment.

In one or more non-limiting embodiments, as shown in FIGS. 1-3, tile support device 102 is a single, elongated horizontal support tool. Further, the tile support device 102 includes an upper section 112 and a lower section 114 as shown in FIG. 1. The upper section 11 and the lower section 114 are coupled together or formed together. The upper section 112 and lower section 114 may be machined from a single piece of metal, in one or more non-limiting embodiments. Notably, the upper section 112 and lower section 114 may be made entirely of metal or may be mostly made from metal so that the upper section 112 and the lower section 114 is partially made of metal. Further, there may be plastic used at the ends of the upper section 112 and lower section 114 to prevent any scratching of any countertops, such as countertop surfaces 412. It may be preferable for the tile support device 102 to be made primarily or entirely from a sturdy metal in order to be heavy enough to support the weight of any tile (e.g., such as tile 502 shown in FIG. 5-7) supported by the tile support device 102 and to be sturdy enough to stay in place on each countertop (e.g., countertops 402 and 404 shown in FIG. 4). It may be preferable that the tile support device 102, in one or more non-limiting embodiments, be made from a thick piece of aluminum, such as a one-inch-thick piece of aluminum, including but not limited to, type 6064 aluminum bar stock. One of ordinary skill in the art will understand that any other material known in the art, including plastic, wood, or any other material, may be used to manufacture and to machine the tile support device 102 and any other thickness other than the thickness described above may be used instead.

The upper section 112 is integrally formed with the lower section 114 out of a single piece of metal in one or more non-limiting embodiments. In alternative embodiments, the upper section 112 may be separately made from the lower section 114, and then may be joined together using any means of attachment known in the art. Further, the end portions, such as end portions extended portions 410*a* and 410*b* as shown in an exemplary embodiment in FIG. 4 may be made from plastic molded pieces so that the pieces are not all formed from a single machined piece of metal.

In addition to the above, the tile support device 102 includes a front facing area or front side 104, a back facing area or back side 106, a first side or left side 108, and a second side or right side 110. A bottom surface of the upper section 112 is attached to the top surface of the lower section 114 regardless whether the upper section 112 is separately machined from the lower section 114 or whether the upper section 112 and the lower section 114 are machined as a single unit.

FIGS. 2A-2B show further close up views of the first and second side ends 108 and 110 of the tile support device 102 as well as other components of the tile support device 102. FIG. 2A and FIG. 2B show the upper section 112 includes a top surface 203 that is flat and straight and long enough to extend past the lower section 114 in a non-limiting embodiment. The upper section 112 of the tile support device 102 further includes a slope 204 that extends downwardly at an angle and terminates just above the top section or support ledge 202 of the lower section 114. The slope 204 is a surface of the upper section 112 that slants down towards the lower section 114 on the backside 104 of the tile support device 102. In one or more non-limiting embodiments, the slope 204 may be at least 45 degrees. One of ordinary skill in the art may anticipate that any other angle measurement may alternatively be used as desired and that the angle of the slope 204 may vary in one or more non-limiting embodiments.

As shown in FIG. 2A and FIG. 2B, each side 108 and 110 of the tile support device 102 includes a side end 206 for the upper section 112 and further includes a side end 208 for the lower section 114. Each side end 206 for the upper section 112 and the side end 208 for the lower section 114 may be identical mirrors of each other on each opposite side of the tile support device 102 in one or more non-limiting embodiments.

The lower section 114 of the tile support device 102 may include a unique component of the tile support device. The tile support ledge 202 of the tile support device 102 is located on the lower section 114 of the tile support device 102. The tile support ledge 202 is the flat top surface area of the lower section 114 extending along the length of the lower section 114 of the tile support device 102. The tile support ledge 202 of the tile support device 102 supports any tile arranged on a first level, such as, tile 502 arranged in a row on first level 702 as shown in FIG. 7 between two countertops where there is a gap or space, such as countertops 402 and 404 shown in FIG. 4 and in FIG. 7.

FIG. 3 shows a bottom perspective view of the tile support device 102. The bottom 304 of the tile support device 102 may be the bottom surface of the lower section 114 as well. The back surface 210, as shown in FIGS. 2A-3, of the lower section 114 is the surface that abuts against and makes contact with the wall surface (e.g., wall surface 506 as shown in FIG. 5) when the tile support device 102 is slid and/or pushed against the wall to support tile 502 that is drying and in the process of bonding to the wall surface 506.

Figure 4:
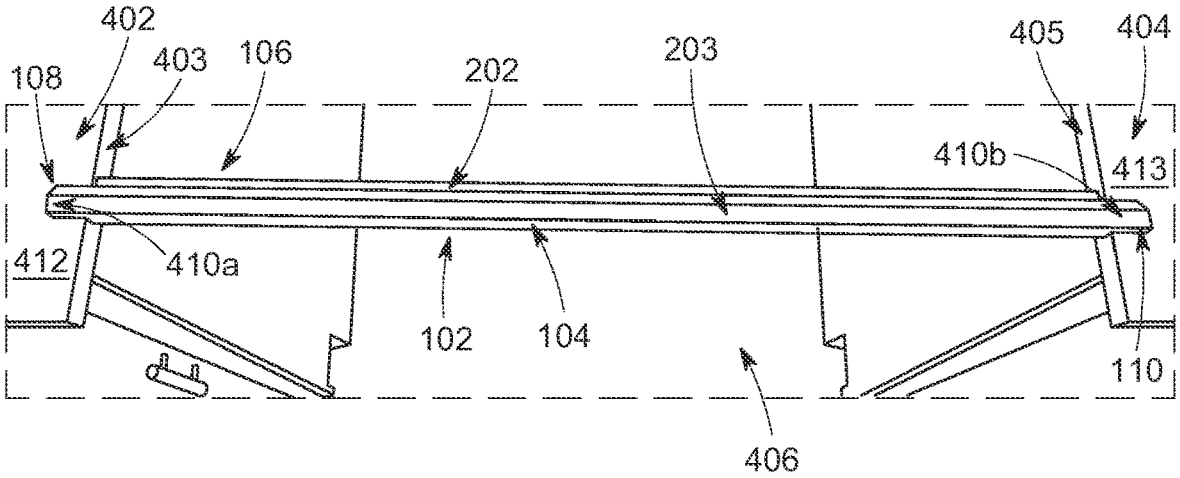
FIG. 4 is a pictorial illustration of the tile support device shown in FIG. 1 spanning a gap and empty space between two countertops in accordance with an illustrative embodiment.

As shown in FIG. 3, it is noted that the length of the lower section 114 of the tile support device 102 is shorter than the full length of the upper section 112 of the tile support device 102 (as shown more clearly in FIG. 4). Accordingly, there is a distance 302 separating the side end 206 of the upper section 112 from the side end 208 of the lower section 114 on both the first end 108 and second end 110 of the tile support device 102, as shown in FIG. 3. The distance 302 is located on both the first end 108 and the second end 110 of the tile support device 102 and spans the difference in distance between the length of the upper section 112 and the lower section 114 as shown in FIG. 3.

FIG. 3 further shows how the lower section 114 may be formed as a rectangular mostly metallic bar having a rectangular side profile in a non-limiting embodiment. In a non-limiting embodiment, the upper section 112 has an irregular trapezoidal shape for its side profile due to the slanted slope 204 on the upper section 112. The upper section 112 may have an irregular trapezoidal shape as opposed to a perfect trapezoidal shape due to the inclusion of the straight side 216 as shown in FIG. 2B of the upper section 112.

Further, as shown in FIG. 2B, the upper section 112 is offset or shortened in its width compared with the lower section 114, in order for the tile support ledge 202 to be exposed and extend along a top surface of the lower section 114 and for the sloped surface 204 to slant down towards the top surface and support ledge 202 of the lower section 114.

FIG. 4 illustrates the tile support device 102 positioned on a first countertop 402 and a second countertop 404 and spanning over a gap area 406 in a house or other type of property. It is noted that the tile support device 102 may be used to support drying tile 502 utilized in any type of property without limitation thereto.

The gap area 406 between a first countertop 402 and a second countertop 405 may serve multiple purposes. In one non-limiting embodiment, the gap area 406 may be the designated location for a stove unit to be inserted and positioned against the wall surface 506 between each countertop 402 and 404. In other embodiments, another unit may be positioned in this location, including, but not limited to, one or more refrigerators, microwaves, cabinets, islands, or any other type of unit or fixture that may appear in a home or apartment. As noted above, it is common for a gap 406 or empty space to be created between two level countertops 402 and 402 and for a stove unit to be inserted in this space in one or more homes or apartments or other type of property. The tile installer or contractor is often contracted to apply a decorative and functional backsplash over this gap area 406. In one or more non-limiting embodiments, the distance from a first side 403, as shown in FIG. 4, of a first countertop 402 to a second side 405 of the second countertop 404 may be a standardized 30 inches. It is noted that the distance between a first side 403 of a first countertop 402 and a second side 405 of the second countertop 404 may be any other measurement or dimension other than 30 inches.

As shown in FIG. 4, a portion of the first side 108 of the tile support device 102 may be configured to extend past the gap 406 and is configured to contact and rest onto a top surface 412 of the first countertop 402 and to stay in place on the top surface 412 of the first countertop 402 by virtue of the extended portion 410*a* of the upper section 112 of the tile support device 102. Similarly, another extended portion 410*b* of the second side 110 of the tile support device 102 is configured to extend past the gap 406 and is configured to contact and rest onto a top surface 413 of the second countertop 404 and to also stay in place on the top surface 413 of the second countertop 404. In a non-limiting embodiment, each extended portion 410*a*, 410*b* extends a same amount past each side end 208 of the lower section 114 and each extended portion 410*a*, 410*b* are the same length.

More specifically, the underside of the upper section 112 that is at least a measured distance 304 (e.g., as shown in FIG. 3) is designed to fit exactly between a side surface 403 of the first countertop 402 and a side surface 405 of the second countertop 404. In particular, the sides 208 of first side 108 and second side 110 of the lower section 114 contact the side surface 403 of the first countertop 402 and the side surface 405 of the second countertop 404 on each side 108 and 110 of the tile support device 102. While the upper section 112 is configured to be long enough to span past the sides 403, 405 of the first countertop 402 and second countertop 404, respectively, due to the inclusion of the extended portions 410*a* and 410*b*, the lower section 114 of the tile support device 102 is configured to be measured to fit exactly against or substantially almost exactly between a side 403 of the first countertop 402 and a side 405 of the second countertop 404. Thus, the length of the lower section 114 of the tile support device 102 is the same as the length of the gap 406 between each countertop 402 and 404. The length of the upper section 112 of the tile support device 102 is longer than the length of the gap 406, as shown in FIG. 4 by virtue of the inclusion of extended portions 410*a* and 410*b* as shown in FIG. 4.

FIG. 5 shows the tile support device 102 being positioned in preparation for use to support one or more tiles 502. The tile support device 102 may support any type of tile used by tile installers and applied to a wall surface 506, including, but not limited to ceramic tiles.

FIG. 5 shows that a tile installer or contractor may include one or more tiles 502 along the wall surface 506 and position a spacer 504 between each tile 502. Spacers 504 may be inserted between each tile 502 without having to glue or attach the spacers 502 using a fastener. The spacers 504 may optionally be positioned between each tile to allow room for additional grout and/or caulk to be applied between each tile 502 once the tiles 502 have bonded to the wall surface 506 and the bonding material applied to the back of the tile 502 has had enough drying time. To bond the tiles 502 to the wall surface 506, the tile installer or contractor may apply a bonding material to the back surface of the tile 502. Conventionally tile installers may use mortar or grout or mastic to the back of each piece of tile 502 and apply the tile 502 to the wall surface 506.

As shown in FIG. 5, the contractor or tile installer has slid and/or pushed the tile support tool 102 towards the wall surface 506 behind each countertop 402 and 404 and in front of the gap area 406 such that the front side 104 is furthest away from the wall surface and the back surface 106 of the tile support device 102 is closest to the wall surface 506 where the tile 502 will be installed. The tile installer can slide or push the tile support device 102 towards the wall surface 506 while the tile support device 102 is located in place on each countertop 402 and 404 as shown in FIG. 5-6.

More specifically, the back surface 210 of the lower section 114 of the tile support device 102 abuts against the wall surface 506. Further, the support ledge 202 of the tile support device 102 is closely positioned near the wall surface 506 in this orientation when prepared for use to support one or more levels of tile 502.

The tile installer or contractor may initially position the tile support device 102 as shown in FIG. 4 where the tile support device 102 is positioned away from the wall surface 506 but still contacting each countertop 402 and 404 and spanning the gap 406 between each countertop 402 and 404. Then, the tile installer or contractor may push the tile support device 102 towards the wall surface 506 until a back surface 106 of the tile support device 102, and more specifically, the back surface 210 of the lower section 114 of the tile support device 102, abuts against the wall surface 506. When the back surface 210 is pushed against and in contact or almost in contact with the wall surface 506 beneath the tiles 502, the support ledge 202 of the lower section 114 is able to support the bottom surfaces of any drying tile 502.

In use, as shown in FIG. 4-7, the back side 104 of the tile support device 102 faces a wall surface 506 such that the support ledge 202 can be located closest to the wall surface 506. It is noted that depending on the thickness of the tile 502 the tile installer or other contractor may pull the tile support device 102 slightly further away from the wall surface 506 in order to accommodate the thickness of the tile 502.

FIG. 6 shows that the side end 206 of the upper section 112 and the first extended portion 410*a* of the first side 108 may be positioned onto the first countertop 402 and that the tile 502 over the gap 406 is resting on the top surface of the support ledge 202 of the tile support device 102. Similarly, on an opposite side, the side end 206 of the upper section 112 and the second extended portion 410*b* on the second side 110 of the tile support device 102 will rest on the second countertop 404.

FIG. 7 shows that an entire row of tiles 502 on a first level of several levels of tiles is supported by the support ledge 202 of the tile support device 102. In a non-limiting embodiment, if needed, each tile 502 may have a spacer 504 positioned between each tile 502, in one or more non-limiting embodiment, to allow the tiles 502 to properly dry and settle in place and to leave room for any caulking or grout to be applied between each tile. The tile installer or other contractor may build up as many rows and levels 702 of tile 502 as needed, including, but not limited to create and install a desired backsplash. The tile support device 102 may be useful in a variety of locations during installation of tile, including in the kitchen, bathroom, dining room, or any other location where tile 502 may be applied to a wall surface that includes a gap area 406 between two countertops 402 and 404 or other level, plane surface.

As noted above, the tile support device 102 is machined or otherwise manufactured from a sturdy material (e.g., such as a metal) to be able to support the weight of the first level 702 of tile 502 and all the subsequent levels layered above the first level 702 of tile 502 as the tile dries and bonds to the wall surface 506. Notably, the tile support device 102 can be freely removed without having to detach any fasteners or remove any glue or other type of attachment mechanism between the tile support device 102 and the wall surface 506. The tile support 102 is not fastened or adhered or otherwise attached or held against the wall surface 506. Advantageously, by virtue of the respective lengths and form and design of the upper section 112 and the lower section 114 of the tile support device 102, the tile support device 102 is usefully able to span the length of the gap 406 between a first countertop 402 and a second countertop 404 to support multiple levels 702 of drying tile 502.

Once the tile installer or contractor determines that sufficient time has passed and the tile 502 has been allowed to properly bond to the wall surface 506, the tile installer can remove the tile support device 102. To remove the tile support device 102, the tile installer or other contractor grabs hold of the front surface 104 of the tile support device 102. The tile installer or other contractor may grab the tile support device 102 with one hand with their fingers gripping the top surface 203, as shown in FIGS. 2A-2B, of the upper section 112 and tilt the tile support device 102 so that the tile support device 102 tilts down and then can pull or slide the tile support device 102 away from the wall surface 506 and away from the first level 702 of the row of tiles 502 without having to unfasten or detach any portion of the tile support device from the wall surface. It is recommended that the tile installer or other contractor removes the tile support device 102 by tilting the tile support device 102 down and then pull the tile support device 102 away so as not to disturb the tile 502 against the wall surface 506. It is noted that an advantage of the tile support device 102 is that it may be installed in place and then removed using one hand because the user can grip the top surface 203 and bottom surface of the tile support device 102 using one hand to position in place or remove the tile support device 102.

Figure 8:
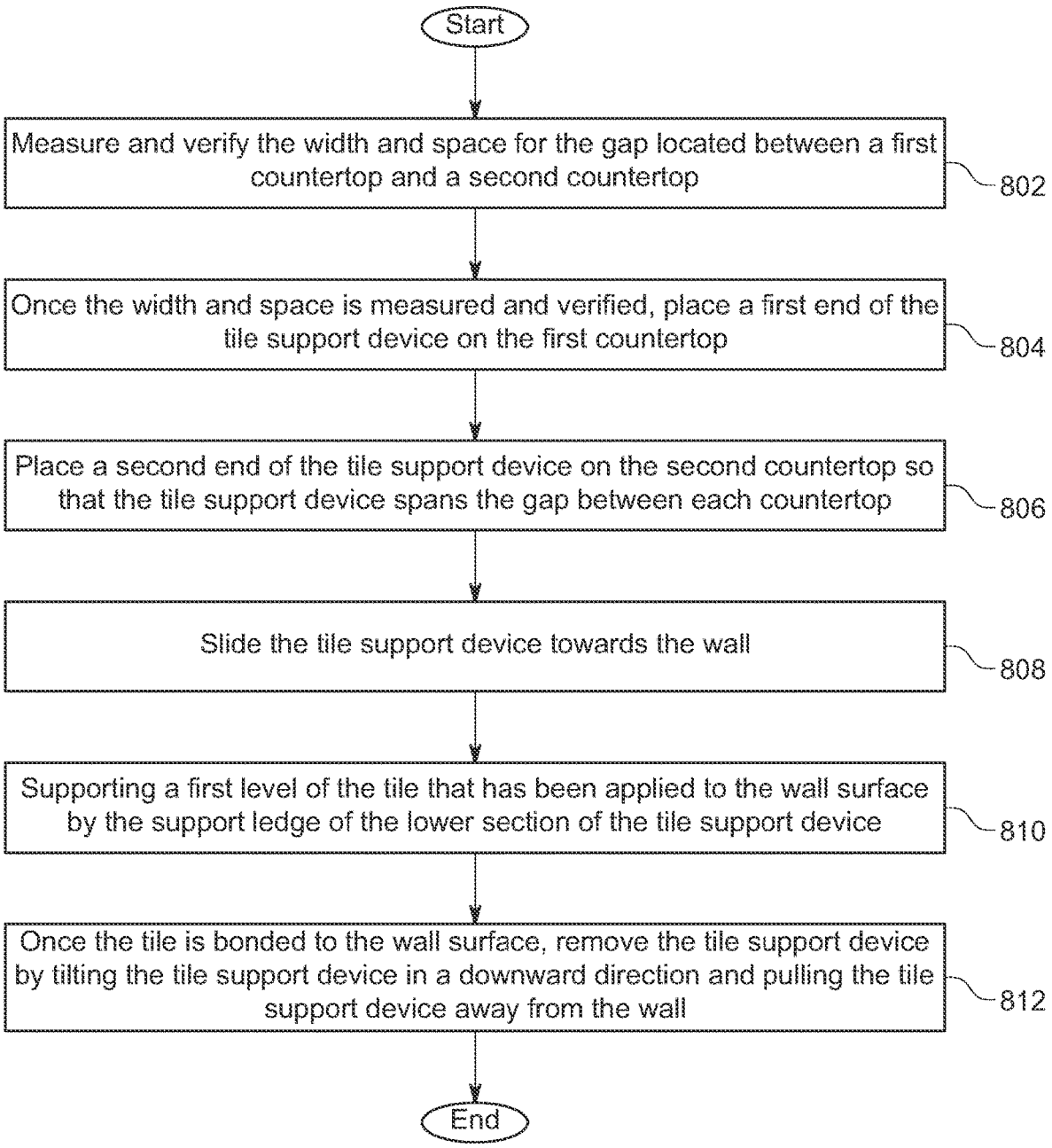
FIG. 8 is a flowchart for an exemplary method of use for using a tile support device.

FIG. 8 is a flowchart of an exemplary method of use of the tile support device 102 according to one or more non-limiting embodiments. At step 802, the method may begin by measuring and verifying the width and space of the gap 406 between a first countertop 402 and a second countertop 404. At step 804, once the width and the space are measured and verified, a first end 108 of the tile support device 102 may be placed on the top of the first countertop 402. At step 806, a second end 110 of the tile support device 102 may be placed on the top of the second countertop 404 so that the tile support device 102 spans the entire gap 406 between each countertop 402 and 404. At step 808, the tile installer may slide or otherwise push the tile support device 102 towards the wall surface 506 so that the tile support device 102 is pushed up against the wall surface 506 (e.g., as shown in FIGS. 5-6) or as close to the wall surface 506 as possible depending upon a thickness of tile 502 that is being supported by the tile support device 102. At step 810, a first level of the tile 502 that has been applied to the wall surface 506 is supported by the support ledge 202 of the lower section 114 of the tile support device 102. At step 812, after the tile 502 has bonded to the wall surface 506, the tile support device 102 is removed by tilting the tile support device 102 in a downward direction and then pulling the tile support device 102 away from the wall 506. The tile support device 102 may be used as many times as needed for other tile installations.

Many modifications may be made to the tile support device 102 as shown in FIGS. 1-8 and described above. For example, the angle of the slope 204 may be varied over a variety of angles and may be machined to another angle other than 45 degrees. Additionally, the width of the tile support ledge 202 may be varied in order to accommodate a variety of widths of tile 502. The upper section 112 of the tile support device 102 may be made longer so as to contact even more surface area of the top sides 412 and 413, respectively, of each countertop 402 and 404. Further, in one or more non-limiting embodiments, the tile support device 102 may be configured to extend and retract to a minimum and maximum length. In one or more non-limiting embodiments, a company may include any type of logo or image or advertising or branding along the exposed surface on the front side 104 of the tile support device 102.

Further, the tile support device 102 may be utilized for other purposes other than to support tile 502. For example, in some cases, a contractor may use the tile support device 102 to catch any grout that drips from a wall surface 506 when applying grout to brick or tile or another surface.

Advantageously, the tile support device 102 reduces any labor or other equipment needed to repair the wall surface 506 after the tile 502 has bonded to the wall surface 506 because the tile support device 102 does not have to be attached to the wall surface 506 in order to support the tile 502. Rather, the form and arrangement of components of the tile support device 102 enables the tile support device 102 to support the applied and installed tile 502 as it dries and bonds to the wall surface 506 without damaging the underlying wall surface 506.

Many other uses and advantages are offered by the system and method for the tile support device 102 described above in one or more non-limiting embodiments in the present description.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components. The term "set" as used herein may mean "one or more items."

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A tile support device, comprising:

an elongated body that is a single piece or a single unit and horizontally oriented, comprising:

an upper section having a top surface and a sloping back surface, wherein the upper section further comprises two side ends; and a lower section comprising a support ledge and two side ends, wherein the support ledge is a flat, top surface of the lower section and is offset from the sloping back surface of the upper section, and wherein the sloping back surface of the upper section terminates just before the support ledge, and wherein the two side ends of the upper section included extended portions that each extend a measurable distance past each side end of the lower section.

2. The tile support device of claim 1, wherein said each side end of the upper section is an irregular trapezoidal shape having a straight front surface and the sloping back surface on an opposed side of the straight front surface.

3. The tile support device of claim 1, wherein the lower section is rectangular shaped.

4. The tile support device of claim 1, wherein the top surface of the upper section is an elongated flat surface.

5. The tile support device of claim 1, wherein a back surface of the lower section is flat.

6. The tile support device of claim 1, wherein each extended portion extends a same amount past each side end of the lower section and are the same length.

7. The tile support device of claim 1, wherein the tile support device is machined as a single integral piece.

8. The tile support device of claim 1, wherein the tile support device is made partially or entirely of metal.

9. The tile support device of claim 1, wherein the tile support device is configured to support drying tile that is bonded to a wall surface over a gap that exists between a first countertop and a second countertop without having to attach the tile support device to the wall surface.

10. A method for supporting tile applied to a wall surface over a gap between a first countertop and a second countertop, the method comprising:

measuring and verifying a width of the gap between the first countertop and the second countertop;

once the width of the gap is measured and verified, placing a first extended end of an upper section of a tile support device on a top surface of the first countertop, wherein the tile support device comprises:

an elongated body that is a single piece or a single unit and horizontally oriented, comprising:

the upper section having a top surface and a sloping back surface, wherein the upper section further comprises two side ends; and a lower section comprising a support ledge and two side ends, wherein the support ledge is a flat, top surface of the lower section and is offset from the sloping back surface of the upper section, and wherein the sloping back surface of the upper section terminates just before the support ledge, and wherein the two side ends of the upper section included extended portions that each extend a measurable distance past each side end of the lower section;

placing a second extended end of the upper section of the tile support device on a top surface of the second countertop, wherein upon placement, the tile support device spans the gap existing between each countertop;

sliding the tile support device back towards the wall surface until a back side of the lower section of the tile support device contacts the wall surface and/or supports a first level of tile;

supporting the first level of tile that has been applied to the wall surface on the support ledge of the tile support device; and once the first level of tile is bonded to the wall surface, removing the tile support device by tilting the tile support device in a downward direction and pulling the tile support device away from the wall surface.

11. The tile support device of claim 10, wherein the tile support device is not attached or otherwise coupled to the wall surface.

12. The method of claim 10, wherein the first extended end of the upper section contacts the top surface of the first countertop.

13. The method of claim 10, wherein the second extended end of the upper section contacts the top surface of the second countertop.

14. The method of claim 10, wherein bottom surfaces of any tile arranged in the first level of tile are contacting a top surface of the support ledge of the tile support device when the tile support device is installed in place.

15. The method of claim 10, wherein the lower section supports the upper section of the tile support device.

16. The method of claim 10, wherein a first side surface of the lower section contacts a side surface of the first countertop and a second side surface of the lower section contacts a side surface of the second countertop when the tile support device is installed.

17. The method of claim 10, wherein the tile support device is made partially or entirely of metal.

18. The tile support device of claim 10, wherein the tile support device is machined as a single integral piece.

19. The tile support device of claim 10, wherein each extended portion extends a same amount past each side end of the lower section and are the same length.

20. The method of claim 10, wherein the tile support device is installed and removed using one hand.

* * * * *